US012180570B2

(12) United States Patent
Shuto et al.

(10) Patent No.: US 12,180,570 B2
(45) Date of Patent: Dec. 31, 2024

(54) HOT-ROLLED STEEL SHEET

(71) Applicant: NIPPON STEEL CORPORATION, Tokyo (JP)

(72) Inventors: Hiroshi Shuto, Tokyo (JP); Genki Abukawa, Tokyo (JP); Akifumi Sakakibara, Tokyo (JP); Jun Ando, Tokyo (JP); Tetsu Asato, Tokyo (JP); Shota Endo, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 604 days.

(21) Appl. No.: 17/413,824

(22) PCT Filed: Mar. 5, 2020

(86) PCT No.: PCT/JP2020/009310
§ 371 (c)(1),
(2) Date: Jun. 14, 2021

(87) PCT Pub. No.: WO2020/184356
PCT Pub. Date: Sep. 17, 2020

(65) Prior Publication Data

US 2022/0042147 A1 Feb. 10, 2022

(30) Foreign Application Priority Data

Mar. 11, 2019 (JP) ..... 2019-043962

(51) Int. Cl.
*C22C 38/16* (2006.01)
*C21D 6/00* (2006.01)
(Continued)

(52) U.S. Cl.
CPC ..... *C22C 38/16* (2013.01); *C21D 6/005* (2013.01); *C21D 6/008* (2013.01); *C21D 8/0205* (2013.01);
(Continued)

(58) Field of Classification Search
CPC ..... B21B 2261/14
See application file for complete search history.

(56) References Cited

FOREIGN PATENT DOCUMENTS

JP 2000-140930 A 5/2000
JP 2001-334306 A 12/2001
(Continued)

*Primary Examiner* — Nicholas A Wang
(74) *Attorney, Agent, or Firm* — Birch, Stewart, Kolasch & Birch, LLP

(57) ABSTRACT

A hot-rolled steel sheet according to the present invention has a predetermined chemical composition, in which, when a height profile of a surface of the hot-rolled steel sheet is measured in each of five measurement ranges in a rolling direction and a direction perpendicular to the rolling direction, a distance in a height direction from an average height position which is an average of a height position of a point having a highest height position and a height position of a recessed part which is a point having a lowest height position to the recessed part is indicated as $R_1$ (μm) in each of the height profiles, and an average of heights of two measurement points away from the recessed part in the rolling direction or the direction perpendicular to the rolling direction by 5 μm is indicated as $R_2$ (μm), an average value of radii of curvature r represented by Expression (1) is 10 μm or more, and a tensile strength of the hot-rolled steel sheet is 500 MPa or more. $r=(25+|R_2-R_1|^2)/2|R_2-R_1|$ . . . (1)

2 Claims, 2 Drawing Sheets

Figure 1:
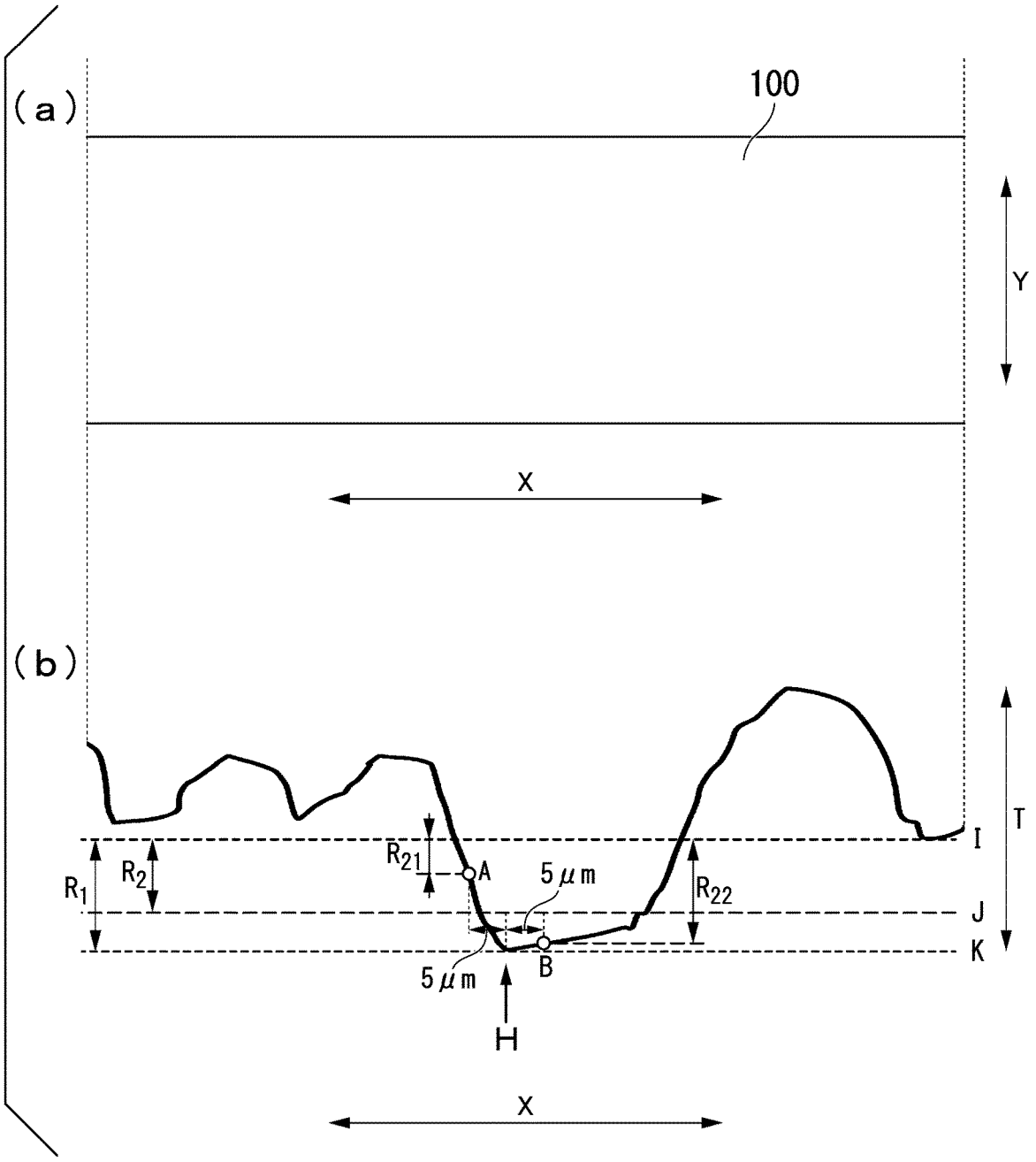

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |

(52) U.S. Cl.

CPC ..... *C21D 8/0226* (2013.01); *C21D 9/46* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C21D 2211/002* (2013.01); *C21D 2211/005* (2013.01); *C21D 2211/008* (2013.01)

(56) References Cited

FOREIGN PATENT DOCUMENTS

| | | | | |
|---|---|---|---|---|
| JP | 2006-316301 | A | | 11/2006 |
| JP | 2006316301 | | * | 11/2006 |
| JP | 2007-211334 | A | | 8/2007 |
| JP | 4404004 | B2 | | 1/2010 |
| JP | 4518029 | B2 | | 8/2010 |
| JP | 5471918 | B2 | | 4/2014 |
| JP | WO2015118863 | | * | 8/2015 |
| WO | WO 2015/118863 | A1 | | 8/2015 |
| WO | WO 2018/117724 | A1 | | 6/2018 |

* cited by examiner

HOT-ROLLED STEEL SHEET

TECHNICAL FIELD

The present invention relates to a high strength hot-rolled steel sheet having excellent fatigue resistance.

Priority is claimed on Japanese Patent Application No. 2019-43962, filed Mar. 11, 2019, the content of which is incorporated herein by reference.

BACKGROUND ART

A so-called hot-rolled steel sheet manufactured by hot rolling is a relatively inexpensive structural material and is widely used as a material for a structural member of a vehicle or an industrial device. In particular, a hot-rolled steel sheet used for a suspension component of a vehicle is being subjected to high-strengthening from the viewpoints of weight reduction, durability, shock absorbing capacity, and the like, is also an important safety-related component, and is thus required to have excellent fatigue resistance.

Fatigue cracks generally occur from the surface of a steel sheet. Therefore, efforts to improve fatigue resistance by controlling the surface properties of the steel sheet have been made.

Patent Documents 1 and 2 report techniques for improving a descaling property by raising a descaling temperature to a high temperature, and reducing the surface roughness Ra of a steel sheet after pickling to 1.2 μm or less, thereby improving fatigue resistance. Patent Document 3 reports a technique for reducing the roughness Ra of the interface between base metal and scale to 1.5 μm or less by controlling the scale thickness before the start of finish rolling, thereby improving fatigue resistance.

Citation List

Patent Document

[Patent Document 1: Japanese Patent No. 4404004
[Patent Document 2: Japanese Patent No. 4518029
[Patent Document 3: Japanese Patent No. 5471918

SUMMARY OF INVENTION

Technical Problem

On the other hand, the position where a fatigue crack occurs is considered to be the portion having the smallest radius of curvature in a recessed part of irregularities on the surface of a steel sheet, but a method of controlling the radius of curvature of this recessed part has not been shown in the knowledge of the related art.

The present invention has come up with various forms shown below in view of the above description, and an object thereof is to provide a high strength hot-rolled steel sheet having excellent tensile strength as high as 500 MPa or more and 1470 MPa or less and excellent fatigue resistance. More preferably, an object of the present invention is to provide a high strength hot-rolled steel sheet having the above properties and further having excellent bending workability.

Solution to Problem (1) A hot-rolled steel sheet according to an aspect of the present invention includes, as a chemical composition, by mass %: C: 0.030% to 0.250%; Si: 0.05% to 2.50%; Mn: 1.00% to 4.00%; Sol. Al: 0.001% to 2.000%; P: 0.100% or less; S: 0.0200% or less; N: 0.01000% or less; Ti: 0% to 0.20%; Nb: 0% to 0.20%; B: 0% to 0.010%; V: 0% to 1.0%; Cr: 0% to 1.0%; Mo: 0% to 1.0%; Cu: 0% to 1.0%; Co: 0% to 1.0%; W: 0% to 1.0%; Ni: 0% to 1.0%; Ca: 0% to 0.01%; Mg: 0% to 0.01%; REM: 0% to 0.01%; Zr: 0% to 0.01%; and a remainder comprising Fe and impurities, in which, when a height profile of a surface of the hot-rolled steel sheet is measured in each of five measurement ranges in a rolling direction and a direction perpendicular to the rolling direction, a distance in a height direction from an average height position which is an average of a height position of a point having a highest height position and a height position of a recessed part which is a point having a lowest height position to the recessed part is indicated as $R_1$ (μm)) in each of the height profiles, and an average of heights of two measurement points away from the recessed part in the rolling direction or the direction perpendicular to the rolling direction by 5 μm is indicated as $R_2$ (μm), an average value of radii of curvature r represented by Expression (1) is 10 μm or more, and a tensile strength of the hot-rolled steel sheet is 500 MPa or more.

$$r=(25+|R_2-R_1|^2)/2|R_2-R_1| \quad (1)$$

(2) In the hot-rolled steel sheet according to (1), when the recessed part in which the Ru is 10 μm or more is referred to as a scale damage portion, an area ratio of the scale damage portion may be 30% or less.

(3) The hot-rolled steel sheet according to (1) or (2) may include at least one selected from the group consisting of, as the chemical composition, by mass %: Ti: 0.001% to 0.20%; Nb: 0.001% to 0.2%; B: 0.001% to 0.010%; V: 0.005% to 1.0%; Cr: 0.005% to 1.0%; Mo: 0.005% to 1.0%; Cu: 0.005% to 1.0%; Co: 0.005% to 1.0%; W: 0.005% to 1.0%; Ni: 0.005% to 1.0%; Ca: 0.0003% to 0.01%; Mg: 0.0003% to 0.01%; REM: 0.0003% to 0.01%; and Zr: 0.0003% to 0.01%.

Advantageous Effects of Invention

According to an embodiment of the present invention, it is possible to obtain a hot-rolled steel sheet having excellent tensile strength as high as 500 MPa or more and 1470 MPa or less and excellent fatigue resistance. Furthermore, according to a preferred embodiment of the present invention, it is possible to obtain a hot-rolled steel sheet having the above properties and further having excellent bending workability capable of suppressing the occurrence of a bend inside crack.

BRIEF DESCRIPTION OF DRAWINGS (a) of FIG. 1 is a schematic view of the sheet surface of a hot-rolled steel sheet in a plan view, and (b) of FIG. 1 is a side view when viewed in a sheet thickness direction.

Figure 2:
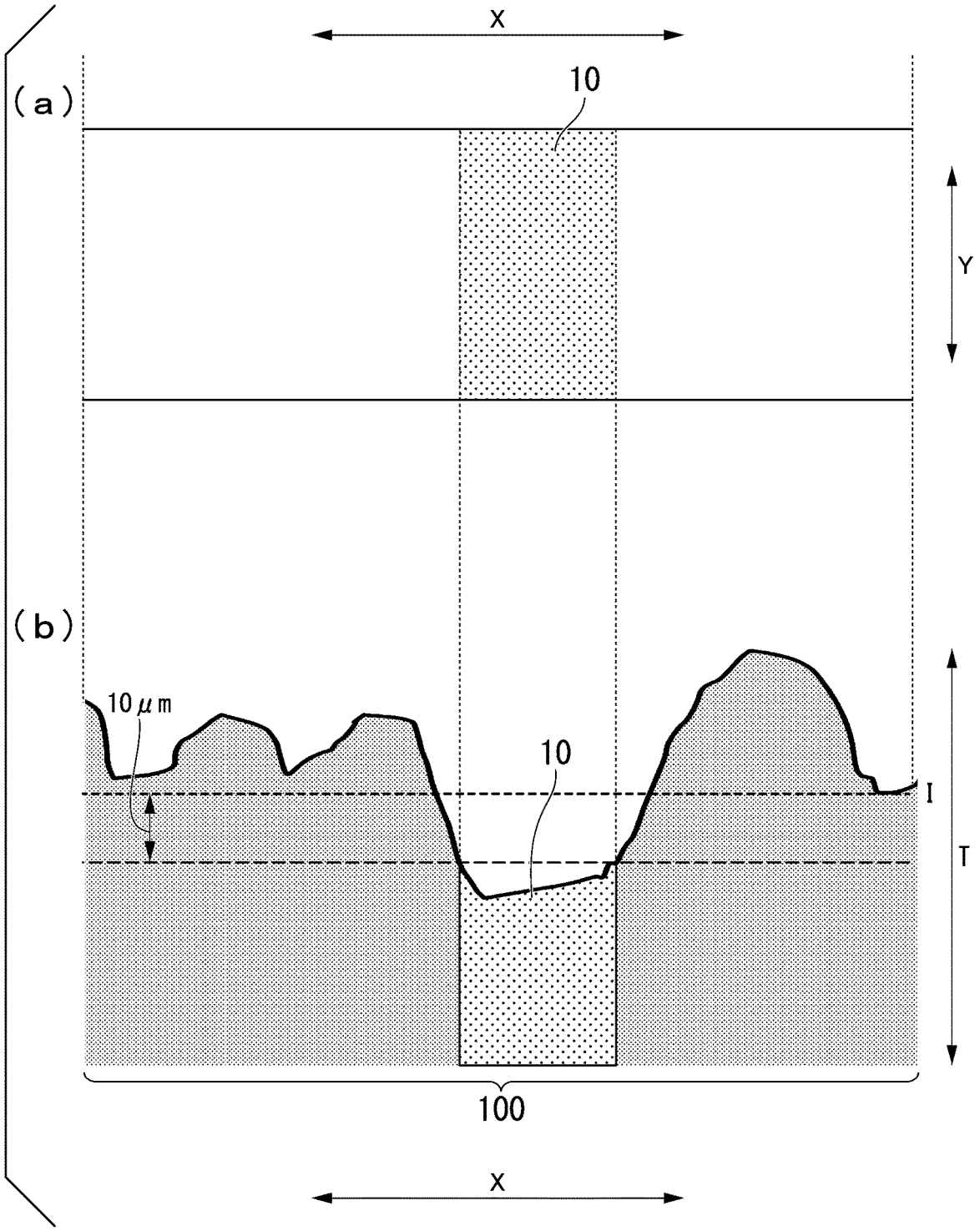

(a) of FIG. 2 is a schematic view of the sheet surface of the hot-rolled steel sheet in a plan view, and (b) of FIG. 2 is an example of 3D image data acquired from the hot-rolled steel sheet.

DESCRIPTION OF EMBODIMENTS

Hereinafter, a hot-rolled steel sheet according to an embodiment of the present invention will be described in detail. However, the present invention is not limited to the configuration disclosed in the present embodiment, and various modifications can be made without departing from the gist of the present invention. Furthermore, the numerical limit range described below includes a lower limit and an upper limit Numerical values indicated with "more than" or "less than" do not fall within the numerical range. "%" regarding the amount of each element means "mass %".

First, the findings of the present inventors who came up with the present invention will be described.

The present inventors intensively investigated the fatigue resistance of a high strength steel sheet, and found that when the radius of curvature of a recessed part on the surface of the steel sheet exceeds a predetermined value, the time intensity of fatigue increases. This mechanism is presumed as follows. When the steel sheet repeatedly undergoes a load, intrusion, which is the initial stage of a fatigue crack, is formed in the recessed part on the surface of the steel sheet. The larger the radius of curvature of the recessed part, the smaller the stress concentration. Therefore, the stress concentration on the tip end of the recessed part is relaxed, the formation of intrusion is suppressed, and the occurrence of a fatigue crack is suppressed. Since it is difficult to relax such local stress concentration only by controlling the average roughness Ra and the maximum height roughness Rz, which have been used as indexes of surface roughness in the related art, there are cases where it is difficult to obtain an effect of improving fatigue resistance.

The present inventors also found an effective hot rolling method for obtaining the radius of curvature of the recessed part. The radius of curvature of the recessed part is characterized by the growth rate of scale during hot rolling, and it was found that this can be achieved by forming a water film on the surface of the steel sheet during hot rolling under certain conditions.

Furthermore, the present inventors also investigated the bending workability of the high strength steel sheet, and found that as the strength of the steel sheet increases, a crack is likely to occur from the inside of a bend during bending (hereinafter, referred to as a bend inside crack).

The mechanism of the bend inside crack is presumed as follows. During bending, compressive stress is generated inside the bend. At first, working proceeds while the entire inside of the bend is uniformly deformed. However, as the working amount increases, the deformation cannot be carried only by the uniform deformation, and the deformation progresses with local concentration of strain (generation of a shear deformation band).

As this shear deformation band further grows, a crack occurs along the shear band from the surface of the inside of the bend and grows. It is presumed that the reason why the bend inside crack is more likely to occur with high-strengthening is that uniform deformation is less likely to proceed due to a decrease in work hardening ability caused by the high-strengthening, biased deformation is likely to occur, and a shear deformation band is generated at an early stage of working (or under loose working conditions).

According to the research by the present inventors, it could be seen that a bend inside crack is likely to occur in a steel sheet having a tensile strength of 780 MPa class or higher, becomes more significant in a steel sheet of 980 MPa class or higher, and become a more significant problem in a steel sheet of 1180 MPa class or higher. The present inventors also found that even in a steel sheet of 500 MPa or more, there are cases where a bend inside crack becomes a problem when the working amount is large.

1. Chemical Composition

Hereinafter, the composition of the hot-rolled steel sheet according to the present embodiment will be described in detail. The hot-rolled steel sheet according to the present embodiment contains base elements as a chemical composition, optional elements as necessary, and the remainder comprising Fe and impurities.

In the chemical composition of the hot-rolled steel sheet according to the present embodiment, C, Si, Mn, and Al are the base elements (main alloying elements).

(C: 0.030% or More and 0.250% or Less)

C is an important element for securing the strength of the steel sheet. When the C content is less than 0.030%, a tensile strength of 500 MPa or more cannot be secured. Therefore, the C content is set to 0.030% or more, and preferably 0.050% or more.

On the other hand, when the C content exceeds 0.250%, the weldability deteriorates. Therefore, the upper limit thereof is set to 0.250%. The C content is preferably 0.200% or less, and more preferably 0.150% or less.

(Si: 0.05% or More and 2.50% or Less)

Si is an important element for increasing the material strength through solid solution strengthening. When the Si content is less than 0.05%, the yield strength decreases. Therefore, the Si content is set to 0.05% or more. The Si content is preferably 0.10% or more, and more preferably 0.30% or more.

On the other hand, when the Si content exceeds 2.50%, the surface properties deteriorate. Therefore, the Si content is set to 2.50% or less. The Si content is preferably 2.00% or less, and more preferably 1.50% or less.

(Mn: 1.00% or More and 4.00% or Less)

Mn is an element effective in increasing the mechanical strength of the steel sheet. When the Mn content is less than 1.00%, a tensile strength of 500 MPa or more cannot be secured, which is not preferable. Therefore, the Mn content is set to 1.00% or more. The Mn content is preferably 1.50% or more, and more preferably 2.00% or more.

On the other hand, when Mn is excessively added, the structure becomes non-uniform due to Mn segregation and the bending workability decreases, which is not preferable. Therefore, the Mn content is set to 4.00% or less, preferably 3.00% or less, and more preferably 2.60% or less.

(sol. Al: 0.001% or More and 2.000% or Less)

Al is an element having an action of deoxidizing steel to achieve soundness of the steel sheet. When the sol. Al content is less than 0.001%, deoxidation cannot be sufficiently achieved. Therefore, the sol. Al content is set to 0.001% or more. However, in a case where sufficient deoxidation is required, it is more desirable to add 0.01% or more of sol. Al. The sol. Al content is more preferably 0.02% or more.

On the other hand, when the sol. Al content exceeds 2.000%, the weldability is significantly decreased, oxide-based inclusions are increased in amount, and the surface properties are significantly deteriorated, which is not preferable. The sol. Al content is set to preferably 2.000% or less, preferably 1.500% or less, and more preferably 1.000% or less. There is concern that dual phase rolling may occur during hot rolling and the ductility may decrease due to a processed ferrite structure. Therefore, the sol. Al content is even more preferably 0.300% or less. Since there is concern that a layer containing Al oxides may remain on the surface after pickling and the chemical convertibility may deteriorate, the sol. Al content is more preferably 0.150% or less. Since there is concern that a sliver defect caused by the layer containing Al oxides may occur on the surface, the sol. Al content is most preferably 0.080% or less.

Here, sol. Al means an acid-soluble Al which does not form an oxide such as $Al_2O_3$ and which is soluble in acid.

The hot-rolled steel sheet according to the present embodiment contains impurities as the chemical composition. The "impurities" indicate those that are incorporated from ore or scrap as a raw material or from a manufacturing environment when steel is industrially manufactured. For example, the impurities mean elements such as P, S, and N. These impurities are preferably limited as follows in order to sufficiently exhibit the effects of the present embodiment. In addition, since the amount of the impurities is preferably small, it is not necessary to limit the lower limit, and the lower limit of the impurities may be 0%.

(P: 0.100% or Less)

P is an impurity generally contained in steel, but has an action of increasing the tensile strength. Therefore, P may be positively contained. However, when the P content exceeds 0.100%, the weldability is significantly deteriorated, which is not preferable. Therefore, the P content is limited to 0.100% or less. The P content is preferably limited to 0.050% or less. In order to obtain the effect of the above action more reliably, the P content may be set to 0.001% or more.

(S: 0.0200% or Less)

S is an impurity contained in steel, and the smaller the amount, the more preferable it is from the viewpoint of weldability. When the S content exceeds 0.0200%, the weldability is significantly decreased, the amount of MnS precipitated is increased, and the low temperature toughness decreases, which is not preferable. Therefore, the S content is limited to 0.0200% or less. The S content is limited to preferably 0.0100% or less, and more preferably 0.0050% or less. From the viewpoint of desulfurization cost, the S content may be set to 0.001% or more.

(N: 0.01000% or Less)

N is an impurity contained in steel, and the smaller the amount, the more preferable it is from the viewpoint of weldability. When the N content exceeds 0.01000%, the weldability is significantly decreased, which is not preferable. Therefore, the N content may be limited to 0.01000% or less, and preferably 0.00500% or less.

The hot-rolled steel sheet according to the present embodiment may contain optional elements in addition to the base elements and impurities described above. For example, instead of a portion of Fe in the remainder described above, Ti, Nb, B, V, Cr, Mo, Cu, Co, W, Ni, Ca, Mg, REM, and Zr may be contained as the optional elements. These optional elements may be contained according to the purpose. Therefore, it is not necessary to limit the lower limits of these optional elements, and the lower limits thereof may be 0%. In addition, even if these optional elements are contained as impurities, the above effects are not impaired.

(Ti: 0% or More and 0.20% or Less)

Ti is an element that precipitates as TiC in ferrite or bainite in the structure of the steel sheet during cooling and coiling of the steel sheet, and thus contributes to an improvement in strength. When the Ti content exceeds 0.20%, the above effects are saturated and the economic efficiency is lowered. Therefore, the Ti content is set to 0.20% or less. The Ti content is preferably 0.18% or less, and more preferably 0.15% or less. In order to obtain the above effects preferably, the Ti content may be 0.001% or more. The Ti content is preferably 0.02% or more.

(Nb: 0% or More and 0.20% or Less)

Nb is an element that precipitates as NbC to improve the strength like Ti, significantly suppresses the recrystallization of austenite, and thus refines the grain size of ferrite. When the Nb content exceeds 0.20%, the above effects are saturated and economic efficiency is lowered. Therefore, the Nb content is set to 0.20% or less. The Nb content is preferably 0.15% or less, and more preferably 0.10% or less. In order to obtain the above effects preferably, the Nb content may be 0.001% or more. The Nb content is preferably 0.005% or more.

In addition, the hot-rolled steel sheet according to the present embodiment preferably contains, as the chemical composition, by mass %, at least one of Ti: 0.001% or more and 0.20% or less or Nb: 0.001% or more and 0.20% or less.

(B: 0% or More and 0.010% or Less)

B segregates at the grain boundaries to improve the grain boundary strength, thereby suppressing the roughness of a punched cross section during punching. Therefore, B may be contained. Even if the B content exceeds 0.010%, the above effects are saturated, which is economically disadvantageous. Therefore, the upper limit of the B content is set to 0.010% or less. The B content is preferably 0.005% or less, and more preferably 0.003% or less. In order to obtain the above effects preferably, the B content may be 0.001% or more.

(V: 0% or More and 1.0% or Less), (Cr: 0% or More and 1.0% or Less), (Mo: 0% or More and 1.0% or Less), (Cu: 0% or More and 1.0% or Less), (Co: 0% or More and 1.0% or Less), (W: 0% or More and 1.0% or Less), and (Ni: 0% or More and 1.0% or Less)

V, Cr, Mo, Cu, Co, W, and Ni are all elements that are effective in securing stable strength. Therefore, these elements may be contained. However, even if each of the elements is contained in an amount of more than 1.0%, the effect of the above action is likely to be saturated, which may be economically disadvantageous. Therefore, it is preferable that the V content, the Cr content, the Mo content, the Cu content, the Co content, the W content, and the Ni content are each set to 1.0% or less. In order to obtain the effect of the above action more reliably, at least one of V: 0.005% or more, Cr: 0.005% or more, Mo: 0.005% or more, Cu: 0.005% or more, Co: 0.005% or more, W: 0.005% or more, or Ni: 0.005% or more is preferably contained.

(Ca: 0% or More and 0.01% or Less), (Mg: 0% or More and 0.01% or Less), (REM: 0% or More and 0.01% or Less), (Zr: 0% or More and 0.01% or Less)

Ca, Mg, REM, and Zr are all elements that contribute to inclusion control, particularly fine dispersion of inclusions, and have an action of enhancing toughness. Therefore, one or two or more of these elements may be contained. However, when any of the elements is contained in an amount of more than 0.01%, there are cases where deterioration of the surface properties becomes apparent. Therefore, the amount of each element is preferably set to 0.01% or less. In order to obtain the effect of the above action more reliably, the amount of at least one of these elements is preferably set to 0.0003% or more.

Here, REM refers to a total of 17 elements including Sc, Y, and lanthanoids, and is at least one thereof. The REM content means the total amount of at least one of these elements. Lanthanoids are added in the form of mischmetal in industrially.

In addition, it is preferable that the hot-rolled steel sheet according to the present embodiment contains at least one of, as the chemical composition, by mass %: Ca: 0.0003% or more and 0.01% or less; Mg: 0.0003% or more and 0.01% or less; REM: 0.0003% or more and 0.01% or less; or Zr: 0.0003% or more and 0.01% or less.

The above-mentioned steel composition may be measured by a general steel analysis method. For example, the steel composition may be measured using inductively coupled plasma-atomic emission spectrometry (ICP-AES). In addition, C and S may be measured using a combustion-infrared absorption method, N may be measured using an inert gas fusion-thermal conductivity method, and O may be measured using an inert gas fusion-non-dispersive infrared absorption method.

2. Surface Properties

For the surface properties of the hot-rolled steel sheet according to the present embodiment, it is important to control the radius of curvature of the recessed part. A method of obtaining the radius of curvature r (unit: μm) of the recessed part is as follows. Using a contact profilometer or a non-contact profilometer, a height profile is measured at any five points with a length of 4 mm or more at intervals of 10 mm or more in a rolling direction (L direction) of the steel sheet and a direction (C direction) perpendicular to the rolling direction. For each of the obtained total of ten height profiles, the place where the height is the lowest is regarded as a recessed part H, and the radii of curvature r of the total of ten recessed parts H are measured. The radius of curvature r (unit: μm) of each of the recessed parts H is obtained by Expression (1) using a height $R_1$ (μm) of the recessed part H and an average $R_2$ (μm) of the heights of two measurement points away from the recessed part on the height profile by 5 μm.

$$r=(25+|R_2-R_1|^2)/2|R_2-R_1| \quad (1)$$

(a) of FIG. 1 is a schematic view of the sheet surface of a hot-rolled steel sheet 100 in a plan view, and (b) of FIG. 1 is a side view when viewed in a sheet thickness direction. Here, X represents the rolling direction (L direction) or the direction (C direction) perpendicular to the rolling direction, and Y represents a direction perpendicular to X.

As shown in (b) of FIG. 1, the "height $R_1$ of the recessed part" represents, when the average height position of the highest height position and the lowest height position (recessed part H) in the height profile is referred to as an average height position I, the distance in the height direction from the average height position I to the recessed part H in units of μm. In addition, "two measurement points away from the recessed part H on the height profile by 5 μm" are points A and B shown in FIG. 1, represent two measurement points away from the recessed part in the rolling direction by 5 μm when the height profile is a profile in the rolling direction of the steel sheet, and represent two measurement points away from the recessed part in the direction perpendicular to the rolling direction by 5 μm when the height profile is a profile in the direction perpendicular to the rolling direction of the steel sheet. $R_2$ is the average value of a height $R_{21}$ of the point A and a height $R_{22}$ of the point B. The above-mentioned "distance" represents an absolute value of the distance in the height direction from the average height position I, and the direction thereof does not matter.

As a result of intensive examinations by the present inventors, it was found that in a steel sheet in which the average value of the radii of curvature r of ten points measured is 10 μm or more, the time intensity at a fatigue of 200,000 times is good regardless of the structure of the base steel sheet. The average value of the radii of curvature r is preferably 16 μm or more, and more preferably 21 μm or more.

In addition, for the surface properties of the hot-rolled steel sheet according to the present embodiment, it is desirable that the area ratio of recessed parts (a recessed part having a depth of 10 μm or more is sometimes referred to as "scale damage portion") having a depth ($R_1$ in Expression (1) above) of 10 μm or more is 30% or less. When the area ratio of the scale damage portions exceeds 30%, local strain concentration occurs in the scale damage portions at an initial stage of bending and causes the occurrence of a crack which is a bend inside crack, which is not preferable.

A detailed method of defining the scale damage portion is as follows. Using a device such as a digital microscope (for example, RH-2000 (manufactured by Hirox Co., Ltd.)) that acquires 3D image data of a target by analyzing the depth of focus, 3D image data of a range of 3000 μm×3000 μm on the surface of a hot-rolled steel sheet is acquired.

(a) of FIG. 2 is a schematic view of the sheet surface of the hot-rolled steel sheet 100 in a plan view, and (b) of FIG. 2 is an example of 3D image data acquired from the hot-rolled steel sheet 100. In the image shown in (b) of FIG. 2, the average height position of the highest height position and the lowest height position is referred to as an average height position I, a region having a height position lower than the average height position I by 10 μm or more is referred to as a scale damage portion 10, and the surface area of the scale damage portion 10 is measured with the device that acquires 3D image data. The area ratio of the scale damage portions 10 is calculated using the 3D image data of the range of 3000 μm×3000 μm on the surface of the hot-rolled steel sheet 100 by dividing the surface areas of all the scale damage portions 10 included in the range by the total surface area of the range.

That is, in a case where there is no region having a height position lower than the average height position by 10 μm or more in the range of 3000 μm)×3000 μm, there is no scale damage portion in the range.

3. Steel Sheet Structure

The hot-rolled steel sheet according to the present embodiment may have any phase of ferrite, pearlite, bainite, fresh martensite, and tempered martensite, pearlite, residual austenite, or the like as a constituent phase of the steel structure, and may contain a compound such as carbonitride in the structure.

For example, the steel structure may contain, by area %, 80% or less of ferrite and 0% to 100% of bainite or martensite, and may further contain 25% or less of residual austenite and 5% or less of pearlite.

4. Mechanical Properties

The hot-rolled steel sheet according to the present embodiment has a tensile strength (TS) of 500 MPa or more as a sufficient strength that contributes to a reduction in the weight of a vehicle. On the other hand, since it is difficult to achieve a tensile strength of more than 1470 MPa with the configuration of the present embodiment, the substantial upper limit of the tensile strength is 1470 MPa or less. Therefore, it is not necessary to set the upper limit of the tensile strength in particular, but in the present embodiment, the substantial upper limit of the tensile strength can be set to 1470 MPa.

A tensile test may be conducted in accordance with JIS Z 2241 (2011).

The hot-rolled steel sheet according to the present embodiment has excellent fatigue resistance. Therefore, when a test piece described in JIS Z 2275 is collected from a ¼ position of the hot-rolled steel sheet according to the present embodiment in the width direction so as to have the direction (C direction) perpendicular to the rolling direction as its longitudinal direction, a plane bending fatigue test in accordance with JIS Z 2275 is conducted, and a time intensity at which the number of fracture repetitions is 200,000 times is referred to as a 200,000 times time intensity, the 200,000 times time intensity is 450 MPa or more, or 55% or more of the tensile strength.

Furthermore, it is preferable that the hot-rolled steel sheet according to the present embodiment has excellent bending workability. Therefore, in the hot-rolled steel sheet according to the present embodiment, it is preferable that the value of limit bending R/t, which is an index value of bend inside cracking, is 2.5 or less. The value of R/t can be obtained by cutting out a strip-shaped test piece from a ½ position of the hot-rolled steel sheet in the width direction, bending both a bend (L-axis bend) having a bending ridge parallel to the rolling direction (L direction) and a bend (C-axis bend) having a bending ridge parallel to the direction (C direction) perpendicular to the rolling direction in accordance with JIS Z 2248 (V-block 90° bending test), and investigating a crack that occurs on the inside of the bend. The minimum bend radius at which no crack occurs is obtained, and a value obtained by dividing the average value of the minimum bend radii of the L-axis and the C-axis by the sheet thickness can be used as the index value of bending workability as the limit bending R/t.

5. Manufacturing Method

Next, a preferred manufacturing method of the hot-rolled steel sheet according to the present embodiment will be described.

A manufacturing process prior to hot rolling is not particularly limited. That is, subsequent to melting in a blast furnace or an electric furnace, various kinds of secondary smelting may be performed, and then casting may be performed by a method such as normal continuous casting, casting by an ingot method, or thin slab casting. In the case of continuous casting, a cast slab may be cooled to a low temperature once and then reheated to be hot-rolled, or the cast slab may be hot-rolled as it is after casting without being cooled to a low temperature. Scrap may be used as the raw material.

The cast slab is subjected to a heating step. In this heating step, the slab is heated to a temperature of 1100° C. or higher and 1300° C. or lower, and then held for 30 minutes or longer. In a case where Ti or Nb is added, the slab is heated to a temperature of 1200° C. or higher and 1300° C. or lower, and then held for 30 minutes or longer. When the heating temperature is lower than 1200° C., Ti and Nb, which are precipitate elements, are not sufficiently dissolved, so that sufficient precipitation hardening cannot be achieved during subsequent hot rolling, and the elements remain as coarse carbides and cause deterioration of formability, which is not preferable. Therefore, in a case where Ti and Nb are contained, the heating temperature of the slab is set to 1200° C. or higher. On the other hand, when the heating temperature exceeds 1300° C., the amount of scale generated increases and the yield decreases. Therefore, the heating temperature is set to 1300° C. or lower. The heating retention time is preferably set to 30 minutes or longer in order to sufficiently dissolve Ti and Nb. Furthermore, in order to suppress excessive scale loss, the heating retention time is set to preferably 10 hours or shorter, and more preferably 5 hours or shorter.

Next, the heated slab is subjected to a rough rolling step of performing rough rolling to obtain a rough-rolled sheet.

The rough rolling may be performed to form the slab into a desired dimensional shape, and the conditions thereof are not particularly limited. The thickness of the rough-rolled sheet affects the amount of temperature decrease from the head end to the tail end of the hot-rolled sheet from the start of rolling to the completion of the rolling in a finish rolling step and is thus preferably determined in consideration of this.

The rough-rolled sheet is subjected to finish rolling. In this finish rolling step, multi-stage finish rolling is performed. In the present embodiment, the finish rolling is performed in a temperature range of 1200° C. to 850° C. under the conditions satisfying Expression (2).

$$F \geq 0.5 \quad (2)$$

F represents the ratio of the time (z seconds) for which the surface of the steel sheet is covered with a water film to the total time (x−y seconds) obtained by subtracting the time (y seconds) for which the steel sheet is in contact with a roll from the time (x seconds) from the start to the completion of the finish rolling. That is, F is represented by F=z/(x−y).

Scale that grows during finish rolling can also cause the formation of recessed parts in the steel sheet, but the growth thereof can be suppressed by covering the surface of the steel sheet with a water film. Therefore, it is desirable that the time for which the surface of the steel sheet is covered with a water film is long. When F≥0.5 is satisfied, a good fatigue time intensity can be obtained. F≥0.6 is preferably satisfied, and F≥0.7 is more preferably satisfied.

As a method of covering the surface of the steel sheet with a water film, there is a method of spraying water between rolls in a spray form.

In addition, in the finish rolling, it is desirable to satisfy Expression (3).

$$K/Si^* \geq 1.2 \quad (3)$$

Here, in the case of Si≥0.35, Si* is set to 140√Si, and in the case of Si<0.35, Si* is set to 80. In addition, Si represents the Si content (mass %) of the steel sheet.

Si* is a parameter related to the steel sheet composition that indicates the ease of formation of a recessed part. When the amount of Si in the steel sheet composition is large, the scale generated on the surface layer during hot rolling grows from wüstite (FeO), which is relatively easily descaled and less likely to form a recessed part in the steel sheet, to take root in the steel sheet, and changes to fayalite ($Fe_2SiO_4$) that is more likely to form a recessed part. Therefore, the larger the amount of Si, that is, the larger the Si*, the easier it is for a recessed part to be formed. Here, the ease of formation of a recessed part due to the addition of Si becomes particularly effective when 0.35 mass % or more of Si is added. Therefore, when 0.35 mass % or more of Si is added, Si* is a function of Si, whereas when the amount of Si is less than 0.35 mass %, Si* becomes a constant.

In addition, K in Expression (3) is represented by Expression (4).

$$K=\Sigma((FT_n-930)\times S_n) \quad (4)$$

Here, $FT_n$ is the temperature (° C.) of the steel sheet in an nth stage of finish rolling, and $S_n$ is the amount of water ($m^3$/min) sprayed onto the steel sheet in a spray form per time between an (n−1)th stage and the nth stage of the finish rolling.

K is a parameter of manufacturing conditions indicating the difficulty of formation of a recessed part. K is a term indicating the effect of, during finish rolling, descaling scale that has not been completely peeled off by descaling before finishing or scale that has been formed again during finish rolling, and indicates that descaling becomes easier by spraying a large amount of water onto the steel sheet in a spray form at a high temperature.

Considering the mechanism of descaling control, the original parameter of the manufacturing conditions indicating the difficulty of formation of a scale damage portion is considered to be obtained by integrating the product of "parameter related to temperature" and "parameter related to the amount of water sprayed" in a temperature range in which finish rolling is performed. This is due to the idea that descaling is promoted by spraying more water at a higher temperature.

In order to achieve simpler parameters in controlling the manufacturing conditions, the present inventors found that the surface roughness can be controlled by using the parameter K (Expression 4) corresponding to the sum of the original parameter divided between rolls. Here, it is considered that the parameter K deviates from the above-mentioned original parameter depending on the number of stands of a finishing mill, a roll-to-roll distance, and a sheet threading speed. However, the present inventors confirmed that the surface roughness can be controlled by using the parameter K when the number of finish rolling stands is in a range of 5 to 8, the roll-to-roll distance is in a range of 4500 mm to 7000 mm, and the sheet threading speed (speed after passing the final stage) is in a range of 400 to 900 mpm.

As shown in Expression (3), when the ratio of the parameter K of the manufacturing conditions indicating the difficulty of formation of a recessed part to the parameter Si* related to the steel sheet composition indicating the ease of formation of a recessed part is 1.2 or more, the area ratio of the scale damage portions can be set to less than 30%, and the occurrence of a crack inside the bend can be suppressed.

When K/Si*≥1.2 and F≥0.5 are simultaneously satisfied, the area ratio of the scale damage portions can be reduced compared to when only F≥0.5 is satisfied, and the occurrence of a crack inside the bend can be further suppressed, which is preferable.

Subsequent to the finish rolling, a cooling step and a coiling step are performed.

In the hot-rolled steel sheet of the present embodiment, the above-mentioned suitable properties are achieved by controlling the surface properties rather than controlling the base structure. Therefore, the conditions of the cooling step and the coiling step are not particularly limited. Therefore, the cooling step and the coiling step after the multi-stage finish rolling may be performed by a normal method.

The hot-rolled steel sheet may be pickled, as necessary, after cooling. The pickling may be performed, for example, in hydrochloric acid having a concentration of 3% to 10% at a temperature of 85° C. to 98° C. for 20 seconds to 100 seconds.

The hot-rolled steel sheet may be subjected to skin pass rolling after cooling, as necessary. Skin pass rolling has effects of preventing stretcher strain that occurs during processing and forming, and of shape correction.

EXAMPLES

Hereinafter, the hot-rolled steel sheet according to the present invention will be described in more detail with reference to examples. However, the following examples are examples of the hot-rolled steel sheet of the present invention, and the hot-rolled steel sheet of the present invention is not limited to the following examples. The conditions in the examples described below are one example of conditions adopted to confirm the feasibility and effects of the present invention, and the present invention is not limited to this one example of conditions. The present invention can adopt various conditions as long as the object of the present invention is achieved without departing from the gist of the present invention.

Steels having the chemical composition shown in Table 1 were cast, cooled as they were or to room temperature once after the casting, then reheated, and heated to a temperature range of 1200° C. to 1300° C. Thereafter, the slabs were rough-rolled to the rough-rolled sheet thickness shown in Tables 2 and 3 at a temperature of 1100° C. or higher to produce rough-rolled sheets.

The rough-rolled sheets were finish-rolled using the following three types of finishing mills.

Rolling mill A: seven stands, roll-to-roll distance 5500 mm, sheet threading speed 700 mpm Rolling mill B: six stands, roll-to-roll distance 5500 mm, sheet threading speed 600 mpm Rolling mill C: seven stands, roll-to-roll distance 6000 mm, sheet threading speed 700 mpm The temperature $FT_n$ of the steel sheet in the nth stage of the finish rolling is shown in Tables 2 and 3, and the amount of water ($m^3$/min) $S_n$ sprayed onto the steel sheet in a spray form per time between an (n−1)th stage and the nth stage of the finish rolling is shown in Tables 4 and 5. The finishing mill used is also shown in Tables 4 and 5.

After the finish rolling was completed, cooling and coiling were performed in each of cooling patterns shown below with the aim of causing the hot-rolled sheet structure to have bainite, ferrite-bainite, and martensite.

(Bainite Pattern: Cooling Pattern B)

A hot-rolled steel sheet produced by this pattern was subjected to a cooling step and a coiling step by being cooled to a coiling temperature of 450° C. to 550° C. at a cooling rate of 20° C./s or more after finish rolling, and then being coiled into a coil shape.

(Ferrite-Bainite Pattern: Cooling Pattern F+B)

A hot-rolled steel sheet produced by this pattern was obtained by performing a cooling step and a coiling step by being cooled to a cooling stop temperature range of 600° C. to 750° C. at an average cooling rate of 20° C./s or more after finish rolling, held in the cooling stop temperature range for 2 to 4 seconds, and further coiled into a coil shape at a coiling temperature of 500° C. to 600° C. at an average cooling rate of 20° C./s or more. In a case where it was necessary to clearly determine the temperature, retention time, and the like in this step, the temperature and time were set using the Ar3 temperature of the following expression. In the following expression, C, Si, Mn, Ni, Cr, Cu, and Mo represent the amounts of the corresponding elements in the unit: mass %.

$$Ar3(°\ C.)=870-390C+24Si-70Mn-50Ni-5Cr-20Cu+80Mo$$

(Martensite Pattern: Cooling Pattern Ms)

A hot-rolled steel sheet produced by this pattern was produced by performing a cooling step and a coiling step by being cooled to a coiling temperature of 100° C. or lower at an average cooling rate of 20° C./s or more after the completion of the finish rolling, and then being coiled into a coil shape.

Each of the hot-rolled steel sheets was pickled in hydrochloric acid having a concentration of 3% to 10% at a temperature of 85° C. to 98° C. for 20 seconds to 100 seconds to peel off scale.

The radius of curvature of a recessed part was measured as follows. Using a contact profilometer, a height profile was measured at five points with a length of 4 mm or more at intervals of 10 mm or more in the rolling direction of the steel sheet and the direction perpendicular to the rolling direction, and the radius of curvature of the recessed part defined above was calculated.

The area ratio of a scale damage portion was measured as follows. Using a microscope (RH-2000 manufactured by Hirox Co., Ltd.), 3D image data of a range of 3000 μm×3000 μm on the surface of the hot-rolled steel sheet was acquired, and the area ratio of the scale damage portion defined above was calculated.

<Method of Evaluating Properties of Hot-Rolled Steel Sheet>

For the tensile strength, a tensile test was conducted in accordance with JIS Z 2241 (2011) using a JIS No. 5 test piece collected from a ¼ position of the hot-rolled steel sheet in the width direction so as to have the direction (C direction) perpendicular to the rolling direction as its longitudinal direction, and a maximum tensile strength TS (MPa) and a butt elongation (total elongation) EL (%) were obtained. A case where TS≥500 MPa was satisfied was determined to be a high strength hot-rolled steel sheet and was thus regarded as being acceptable.

Fatigue strength was obtained by collecting a test piece described in JIS Z 2275 is the ¼ position of the hot-rolled steel sheet in the width direction so as to have the direction (C direction) perpendicular to the rolling direction as its longitudinal direction, and conducting a plane bending fatigue test in accordance with JIS Z 2275. A time intensity at which the number of fracture repetitions was 200,000 times was referred to as a 200,000 times time intensity. A case where the 200,000 times time intensity was 450 MPa or more or 55% or more of the tensile strength was determined to be a hot-rolled steel sheet having excellent fatigue resistance and was thus regarded as being acceptable.

As a bending test piece, a strip-shaped test piece having a size of 100 mm×30 mm was cut out from a ½ position of the hot-rolled steel sheet in the width direction and provided for the following test.

Bending workability was investigated in accordance with JIS Z 2248 (V-block 90° bending test) for both a bend (L-axis bend) having a bending ridge parallel to the rolling direction (L direction) and a bend (C-axis bend) having a bending ridge parallel to the direction (C direction) perpendicular to the rolling direction, the minimum bend radius at which no crack had occurred was obtained, and a value obtained by dividing the average value of the minimum bend radii of the L-axis and the C-axis by the sheet thickness was used as the index value of bendability as the limit bending R/t. A case of R/t≤2.5 was determined to be a hot-rolled steel sheet having excellent bending workability.

However, regarding the presence or absence of a crack, a cross section obtained by cutting the test piece after the V-block 90° bending test in a plane parallel to the bending direction and perpendicular to the sheet surface was mirror-polished, thereafter a crack was observed with an optical microscope, and a case where the length of the crack observed inside the bend of the test piece exceeded 30 μm was determined to have a crack.

TABLE 1

| | Chemical composition (unit: mass %, remainder comprising Fe and impurities) | | | | | | | | | | |
|---|---|---|---|---|---|---|---|---|---|---|---|
| Steel | C | Si | Mn | sol. Al | Ti | Nb | P | S | N | Others | Classification |
| A | 0.060 | 1.20 | 2.60 | 0.100 | 0.110 | 0.020 | 0.010 | 0.0020 | 0.00200 | B:0001 | Example Steel |
| B | 0.060 | 0.05 | 2.50 | 0.030 | | | 0.010 | 0.0010 | 0.00200 | | Example Steel |
| C | 0.070 | 0.80 | 2.20 | 0.050 | 0.120 | 0.018 | 0.010 | 0.0010 | 0.00300 | Ca:0.002 | Example Steel |
| D | 0.095 | 0.92 | 1.33 | 0.021 | | | 0.011 | 0.0030 | 0.00500 | | Example Steel |
| E | 0.060 | 1.50 | 2.20 | 0.030 | 0.110 | 0.020 | 0.010 | 0.0020 | 0.00300 | | Example Steel |
| F | 0.080 | 2.00 | 2.00 | 0.025 | 0.090 | 0.010 | 0.010 | 0.0010 | 0.00300 | Cr:0.4 | Example Steel |
| G | 0.060 | 0.70 | 1.80 | 0.030 | 0.100 | 0.007 | 0.011 | 0.0010 | 0.00300 | V:0.01 | Example Steel |
| H | 0.120 | 1.30 | 1.80 | 0.020 | 0.090 | 0.008 | 0.012 | 0.0010 | 0.00300 | Mo:0.01 | Example Steel |
| I | 0.060 | 1.10 | 1.60 | 0.020 | 0.110 | 0.012 | 0.010 | 0.0010 | 0.00200 | Cu:0.01 | Example Steel |
| J | 0.060 | 1.02 | 1.80 | 0.030 | 0.100 | 0.020 | 0.010 | 0.0010 | 0.00300 | Co:0.1 | Example Steel |
| K | 0.060 | 0.90 | 1.88 | 0.029 | 0.110 | 0.007 | 0.010 | 0.0010 | 0.00300 | W:0.01 | Example Steel |
| L | 0.070 | 1.80 | 1.10 | 0.020 | 0.110 | 0.010 | 0.012 | 0.0030 | 0.00300 | Ni:0.8 | Example Steel |
| M | 0.110 | 1.20 | 1.80 | 0.021 | 0.100 | 0.030 | 0.013 | 0.0010 | 0.00200 | Mg:0.002 | Example Steel |
| N | 0.080 | 0.87 | 1.30 | 0.030 | 0.080 | 0.021 | 0.011 | 0.0020 | 0.00300 | REM:0.001 | Example Steel |
| O | 0.090 | 1.43 | 1.80 | 0.130 | 0.120 | 0.031 | 0.014 | 0.0010 | 0.00200 | Zr:0.002 | Example Steel |
| P | 0.050 | 0.90 | 1.60 | 0.030 | 0.030 | 0.040 | 0.010 | 0.0030 | 0.00300 | B:0.002 | Example Steel |
| Q | 0.090 | 0.90 | 0.42 | 0.021 | | | 0.009 | 0.0100 | 0.00400 | | Comparative Steel |
| R | 0.220 | 1.20 | 2.80 | 0.020 | 0.080 | 0.020 | 0.030 | 0.0020 | 0.00300 | | Example Steel |

TABLE 2

| Note | No. | Kind of steel | Sheet thickness (mm) | Amount of Si (%) | FT1 (° C.) | FT2 (° C.) | FT3 (° C.) | FT4 (° C.) | FTS (° C.) | FT6 (° C.) | FT7 (° C.) |
|---|---|---|---|---|---|---|---|---|---|---|---|
| Comparative Example | 1 | A | 2.8 | 1.20 | 1002 | 995 | 978 | 983 | 957 | 951 | 942 |
| Comparative Example | 2 | A | 2.8 | 1.20 | 1001 | 1002 | 980 | 964 | 958 | 959 | 955 |
| Example | 3 | A | 2.0 | 1.20 | 993 | 986 | 993 | 986 | 974 | 962 | 941 |
| Example | 4 | A | 2.4 | 1.20 | 998 | 981 | 970 | 973 | 964 | 950 | 952 |
| Example | 5 | A | 2.8 | 1.20 | 1002 | 1001 | 978 | 971 | 974 | 943 | 945 |
| Example | 6 | A | 3.2 | 1.20 | 990 | 985 | 970 | 955 | 952 | 943 | 944 |
| Example | 7 | A | 3.8 | 1.20 | 999 | 982 | 984 | 974 | 952 | 946 | 937 |
| Comparative Example | 8 | A | 2.8 | 1.20 | 1058 | 1046 | 1016 | 1004 | 975 | 956 | 946 |
| Example | 9 | A | 2.0 | 1.20 | 1056 | 1042 | 1029 | 1007 | 989 | 961 | 944 |
| Example | 10 | A | 2.4 | 1.20 | 1053 | 1045 | 1017 | 998 | 990 | 967 | 956 |

TABLE 2-continued

| Note | No. | Kind of steel | Sheet thickness (mm) | Amount of Si (%) | FT1 (° C.) | FT2 (° C.) | FT3 (° C.) | FT4 (° C.) | FTS (° C.) | FT6 (° C.) | FT7 (° C.) |
|---|---|---|---|---|---|---|---|---|---|---|---|
| Example | 11 | A | 3.0 | 1.20 | 1066 | 1047 | 1016 | 1009 | 982 | 962 | 933 |
| Example | 12 | A | 3.8 | 1.20 | 1067 | 1043 | 1020 | 1014 | 985 | 959 | 952 |
| Comparative Example | 13 | B | 2.8 | 0.05 | 1020 | 1015 | 991 | 983 | 938 | 923 | 912 |
| Example | 14 | B | 2.0 | 0.05 | 1020 | 994 | 975 | 963 | 928 | 921 | 892 |
| Example | 15 | B | 2.4 | 0.05 | 1021 | 993 | 974 | 940 | 933 | 926 | 890 |
| Example | 16 | B | 2.8 | 0.05 | 1021 | 1005 | 975 | 964 | 948 | 926 | 904 |
| Example | 17 | B | 3.6 | 0.05 | 1018 | 999 | 985 | 954 | 938 | 913 | 895 |
| Example | 18 | B | 4.5 | 0.05 | 1019 | 1011 | 979 | 957 | 930 | 930 | 903 |
| Comparative Example | 19 | B | 2.8 | 0.05 | 1026 | 1009 | 993 | 997 | 988 | 969 | 948 |
| Example | 20 | B | 2.0 | 0.05 | 1019 | 1014 | 990 | 982 | 975 | 951 | 951 |
| Comparative Example | 21 | C | 2.8 | 0.80 | 995 | 989 | 970 | 975 | 972 | 957 | 938 |
| Comparative Example | 22 | C | 2.8 | 0.80 | 1013 | 986 | 979 | 978 | 975 | 964 | — |
| Example | 23 | C | 2.9 | 0.80 | 994 | 979 | 983 | 976 | 953 | 956 | 953 |
| Example | 24 | C | 2.9 | 0.80 | 1065 | 1048 | 1034 | 1018 | 977 | 978 | — |
| Example | 25 | C | 2.9 | 0.80 | 1056 | 1049 | 1025 | 1005 | 992 | 963 | 953 |

TABLE 3

| Note | No. | Kind of steel | Sheet thickness (mm) | Amount of Si (%) | FT1 (° C.) | FT2 (° C.) | FT3 (° C.) | FT4 (° C.) | FTS (° C.) | FT6 (° C.) | FT7 (° C.) |
|---|---|---|---|---|---|---|---|---|---|---|---|
| Example | 26 | C | 2.9 | 0.80 | 1067 | 1051 | 1030 | 1013 | 974 | 955 | 934 |
| Example | 27 | C | 2.9 | 0.80 | 1083 | 1061 | 1052 | 1015 | 1007 | 1004 | 992 |
| Example | 28 | C | 2.9 | 0.80 | 1076 | 1059 | 1035 | 1022 | 1004 | 988 | 987 |
| Example | 29 | C | 2.9 | 0.80 | 1064 | 1064 | 1048 | 1019 | 1021 | 1007 | 975 |
| Comparative Example | 30 | D | 2.9 | 0.92 | 996 | 999 | 985 | 979 | 960 | 945 | 942 |
| Example | 31 | D | 2.9 | 0.92 | 1000 | 992 | 989 | 979 | 960 | 947 | 931 |
| Example | 32 | D | 2.9 | 0.92 | 988 | 994 | 977 | 967 | 956 | 959 | 937 |
| Example | 33 | D | 4.0 | 0.92 | 998 | 975 | 964 | 929 | 927 | 894 | 871 |
| Example | 34 | D | 4.0 | 0.92 | 990 | 965 | 965 | 939 | 937 | 900 | 862 |
| Example | 35 | D | 6.0 | 0.92 | 997 | 975 | 963 | 928 | 944 | 893 | 855 |
| Example | 36 | D | 6.0 | 0.92 | 997 | 975 | 963 | 928 | 944 | 893 | 855 |
| Comparative Example | 37 | E | 2.9 | 1.50 | 1066 | 1030 | 1013 | 1001 | 987 | 952 | 935 |
| Comparative Example | 38 | F | 2.9 | 2.00 | 1056 | 1035 | 1018 | 1007 | 990 | 973 | 957 |
| Example | 39 | G | 2.9 | 0.70 | 1059 | 1053 | 1031 | 999 | 998 | 973 | 957 |
| Example | 40 | H | 2.9 | 1.30 | 1057 | 1036 | 1006 | 991 | 984 | 966 | 946 |
| Example | 41 | I | 2.9 | 1.10 | 1049 | 1044 | 1021 | 994 | 985 | 956 | — |
| Example | 42 | J | 2.9 | 1.02 | 1060 | 1043 | 1012 | 1007 | 982 | 966 | 947 |
| Example | 43 | K | 2.9 | 0.90 | 1064 | 1042 | 1017 | 1007 | 993 | 974 | 941 |
| Example | 44 | L | 2.9 | 1.80 | 989 | 996 | 973 | 972 | 961 | 942 | 943 |
| Example | 45 | M | 2.9 | 1.20 | 1007 | 998 | 992 | 969 | 952 | 957 | 935 |
| Example | 46 | N | 2.9 | 0.87 | 1069 | 1049 | 1015 | 1006 | 985 | 974 | 937 |
| Example | 47 | O | 2.9 | 1.43 | 1047 | 1031 | 1026 | 1002 | 985 | 957 | 946 |
| Example | 48 | P | 2.9 | 0.90 | 1052 | 1050 | 1023 | 1003 | 973 | 974 | 951 |
| Comparative Example | 49 | Q | 2.9 | 0.90 | 1052 | 1040 | 1023 | 1004 | 975 | 967 | 938 |
| Example | 50 | R | 2.9 | 1.20 | 998 | 987 | 982 | 973 | 964 | 952 | 943 |

TABLE 4

| Note | No. | S1 ($m^3$/min) | S2 ($m^3$/min) | S3 ($m^3$/min) | S4 ($m^3$/min) | S5 ($m^3$/min) | S6 ($m^3$/min) | S7 ($m^3$/min) | Rolling mill | Cooling pattern | Ratio F | Si* | K | K/Si* |
|---|---|---|---|---|---|---|---|---|---|---|---|---|---|---|
| Comparative Example | 1 | 0.4 | 1.5 | 0.0 | 0.0 | 0.0 | 0.0 | 0.0 | A | F + B | 0.4 | 153 | 126.1 | 0.8 |
| Comparative Example | 2 | 0.0 | 0.0 | 0.0 | 2.0 | 2.0 | 1.5 | 1.2 | C | F + B | 0.4 | 153 | 196.9 | 1.3 |
| Example | 3 | 0.4 | 1.4 | 1.8 | 1.8 | 1.8 | 0.4 | 0.4 | C | F + B | 1.0 | 153 | 414.4 | 2.7 |
| Example | 4 | 0.0 | 1.2 | 1.8 | 1.8 | 0.0 | 1.5 | 2.4 | A | F + B | 0.9 | 153 | 294.3 | 1.9 |

TABLE 4-continued

| Note | No. | S1 ($m^3$/min) | S2 ($m^3$/min) | S3 ($m^3$/min) | S4 ($m^3$/min) | S5 ($m^3$/min) | S6 ($m^3$/min) | S7 ($m^3$/min) | Rolling mill | Cooling pattern | Ratio F | Si* | K | K/Si* |
|---|---|---|---|---|---|---|---|---|---|---|---|---|---|---|
| Example | 5 | 0.0 | 0.0 | 1.8 | 1.8 | 1.8 | 1.5 | 1.2 | A | B | 0.6 | 153 | 276.5 | 1.8 |
| Example | 6 | 0.0 | 0.0 | 1.8 | 1.8 | 0.0 | 1.5 | 1.2 | A | B | 0.5 | 153 | 152.7 | 1.0 |
| Example | 7 | 0.4 | 1.4 | 1.8 | 1.8 | 1.8 | 0.4 | 0.4 | A | MS | 1.0 | 153 | 324.1 | 2.1 |
| Comparative Example | 8 | 0.0 | 0.0 | 1.8 | 0.0 | 1.8 | 0.0 | 1.2 | A | F + B | 0.4 | 153 | 254.1 | 1.7 |
| Example | 9 | 0.0 | 0.0 | 1.8 | 1.8 | 0.0 | 1.5 | 1.2 | A | F + B | 0.5 | 153 | 379.3 | 2.5 |
| Example | 10 | 0.4 | 1.4 | 1.8 | 1.8 | 1.8 | 0.4 | 0.4 | C | B | 1.0 | 153 | 621.3 | 4.1 |
| Example | 11 | 0.0 | 0.0 | 1.8 | 1.8 | 1.8 | 1.5 | 1.2 | C | MS | 0.6 | 153 | 442.1 | 2.9 |
| Example | 12 | 0.4 | 1.4 | 1.8 | 1.8 | 1.8 | 0.4 | 0.4 | A | F + B | 1.0 | 153 | 646.6 | 4.2 |
| Comparative Example | 13 | 0.4 | 1.5 | 0.0 | 0.0 | 0.0 | 0.0 | 0.0 | A | MS | 0.4 | 80 | 164.4 | 2.1 |
| Example | 14 | 0.4 | 1.4 | 1.8 | 1.8 | 1.8 | 0.4 | 0.4 | A | MS | 1.0 | 80 | 247.5 | 3.1 |
| Example | 15 | 0.0 | 1.2 | 1.8 | 1.8 | 0.0 | 1.5 | 2.4 | A | MS | 0.9 | 80 | 67.7 | 0.8 |
| Example | 16 | 0.0 | 1.2 | 0.0 | 1.8 | 0.0 | 1.5 | 2.4 | A | F + B | 0.7 | 80 | 80.2 | 1.0 |
| Example | 17 | 0.0 | 0.0 | 1.8 | 1.8 | 0.0 | 1.5 | 1.2 | A | F + B | 0.5 | 80 | 77.3 | 1.0 |
| Example | 18 | 0.0 | 1.4 | 1.8 | 1.8 | 0.0 | 0.0 | 0.4 | A | B | 0.8 | 80 | 240.3 | 3.0 |
| Comparative Example | 19 | 0.0 | 0.0 | 0.0 | 1.8 | 0.0 | 0.4 | 0.4 | A | MS | 0.3 | 80 | 141.3 | 1.8 |
| Example | 20 | 0.0 | 1.4 | 1.8 | 1.8 | 1.8 | 0.4 | 0.4 | A | MS | 1.0 | 80 | 412.3 | 5.2 |
| Comparative Example | 21 | 0.4 | 1.5 | 0.0 | 0.0 | 0.0 | 0.0 | 0.0 | A | F + B | 0.4 | 125 | 115.0 | 0.9 |
| Comparative Example | 22 | 0.0 | 0.0 | 0.0 | 0.0 | 0.0 | 0.0 | — | B | F + B | 0.0 | 125 | 0.0 | 0.0 |
| Example | 23 | 0.4 | 1.4 | 1.8 | 1.8 | 1.8 | 0.4 | 0.4 | A | F + B | 1.0 | 125 | 334.6 | 2.7 |
| Example | 24 | 0.0 | 1.4 | 1.8 | 1.8 | 1.8 | 0.4 | — | B | F + B | 0.9 | 125 | 614.0 | 4.9 |
| Example | 25 | 0.4 | 0.0 | 1.8 | 1.8 | 1.8 | 0.4 | 0.4 | A | F + B | 0.6 | 125 | 489.1 | 3.9 |

TABLE 5

| Note | No. | S1 ($m^3$/min) | S2 ($m^3$/min) | S3 ($m^3$/min) | S4 ($m^3$/min) | S5 ($m^3$/min) | S6 ($m^3$/min) | S7 ($m^3$/min) | Rolling mill | Cooling pattern | Ratio F | Si* | K | K/Si* |
|---|---|---|---|---|---|---|---|---|---|---|---|---|---|---|
| Example | 26 | 0.0 | 1.4 | 0.0 | 1.8 | 1.8 | 0.4 | 0.4 | A | B | 0.8 | 125 | 409.6 | 3.3 |
| Example | 27 | 0.4 | 1.4 | 1.8 | 0.0 | 1.8 | 0.4 | 0.4 | A | B | 0.8 | 125 | 658.1 | 5.3 |
| Example | 28 | 0.0 | 1.4 | 1.8 | 1.8 | 0.0 | 0.4 | 0.4 | A | B | 0.9 | 125 | 581.5 | 4.6 |
| Example | 29 | 0.4 | 1.4 | 1.8 | 1.8 | 1.8 | 0.0 | 0.4 | A | B | 0.9 | 125 | 794.1 | 6.3 |
| Comparative Example | 30 | 0.4 | 1.5 | 0.0 | 0.0 | 0.0 | 0.0 | 0.0 | C | B | 0.4 | 134 | 129.9 | 1.0 |
| Example | 31 | 0.4 | 1.4 | 1.8 | 1.8 | 1.8 | 0.4 | 0.4 | A | B | 1.0 | 134 | 369.5 | 2.8 |
| Example | 32 | 0.0 | 1.4 | 0.0 | 1.8 | 1.8 | 0.4 | 0.4 | A | B | 0.8 | 134 | 217.7 | 1.6 |
| Example | 33 | 0.4 | 1.4 | 1.8 | 1.8 | 1.8 | 0.4 | 0.4 | A | B | 1.0 | 134 | 106.2 | 0.8 |
| Example | 34 | 0.0 | 1.2 | 1.8 | 1.8 | 0.0 | 1.5 | 2.4 | A | B | 0.9 | 134 | −87.0 | −0.6 |
| Example | 35 | 0.0 | 1.2 | 0.0 | 1.8 | 0.0 | 1.5 | 2.4 | A | B | 0.7 | 134 | −185.1 | −1.4 |
| Example | 36 | 0.0 | 0.0 | 1.8 | 1.8 | 0.0 | 1.5 | 1.2 | A | B | 0.5 | 134 | −89.7 | −0.7 |
| Comparative Example | 37 | 0.0 | 0.0 | 0.0 | 1.8 | 0.0 | 0.4 | 0.4 | C | F + B | 0.3 | 171 | 135.8 | 0.8 |
| Comparative Example | 38 | 0.0 | 0.0 | 0.0 | 1.8 | 0.0 | 0.4 | 0.4 | C | F + B | 0.3 | 198 | 165.1 | 0.8 |
| Example | 39 | 0.4 | 1.4 | 1.8 | 1.8 | 1.8 | 0.4 | 0.4 | A | F + B | 1.0 | 117 | 680.6 | 5.8 |
| Example | 40 | 0.4 | 1.4 | 1.8 | 1.8 | 1.8 | 0.4 | 0.4 | A | F + B | 1.0 | 160 | 563.8 | 3.5 |
| Example | 41 | 0.4 | 1.4 | 1.8 | 1.8 | 1.8 | 0.4 | — | B | F + B | 1.0 | 147 | 596.8 | 4.1 |
| Example | 42 | 0.4 | 1.4 | 1.8 | 1.8 | 1.8 | 0.4 | 0.4 | A | F + B | 1.0 | 141 | 610.5 | 4.3 |
| Example | 43 | 0.4 | 1.4 | 1.8 | 1.8 | 1.8 | 0.4 | 0.4 | A | F + B | 1.0 | 133 | 640.8 | 4.8 |
| Example | 44 | 0.4 | 1.4 | 1.8 | 1.8 | 1.8 | 0.4 | 0.4 | A | B | 1.0 | 188 | 333.9 | 1.8 |
| Example | 45 | 0.4 | 1.4 | 1.8 | 1.8 | 1.8 | 0.4 | 0.4 | A | B | 1.0 | 153 | 359.8 | 2.3 |
| Example | 46 | 0.4 | 1.4 | 1.8 | 1.8 | 1.8 | 0.4 | 0.4 | A | F + B | 1.0 | 131 | 631.1 | 4.8 |
| Example | 47 | 0.4 | 1.4 | 1.8 | 1.8 | 1.8 | 0.4 | 0.4 | A | F + B | 1.0 | 167 | 606.7 | 3.6 |
| Example | 48 | 0.4 | 1.4 | 1.8 | 1.8 | 1.8 | 0.4 | 0.4 | A | B | 1.0 | 133 | 618.1 | 4.7 |
| Comparative Example | 49 | 0.4 | 1.4 | 1.8 | 1.8 | 1.8 | 0.4 | 0.4 | A | B | 1.0 | 133 | 602.3 | 4.5 |
| Example | 50 | 0.4 | 1.2 | 2.4 | 1.1 | 0.0 | 1.5 | 2.4 | A | B | 0.9 | 153 | 433.9 | 2.8 |

TABLE 6

| Note | No. | Radius of curvature r (μm) | Area ratio (%) | Tensile strength TS (MPa) | Total elongation EL (%) | 200,000 times time intensity (MPa) | 200,000 times time intensity/TS | Limit bending R/t |
|---|---|---|---|---|---|---|---|---|
| Comparative Example | 1 | 8 | 36 | 879 | 18.3 | 430 | 0.49 | 2.7 |
| Comparative Example | 2 | 9 | 28 | 838 | 19.0 | 440 | 0.52 | 2.5 |

TABLE 6-continued

| Note | No. | Radius of curvature r (μm) | Area ratio (%) | Tensile strength TS (MPa) | Total elongation EL (%) | 200,000 times time intensity (MPa) | 200,000 times time intensity/TS | Limit bending R/t |
|---|---|---|---|---|---|---|---|---|
| Example | 3 | 26 | 26 | 847 | 18.4 | 500 | 0.59 | 2.4 |
| Example | 4 | 24 | 29 | 863 | 18.1 | 470 | 0.54 | 2.5 |
| Example | 5 | 18 | 29 | 973 | 16.9 | 460 | 0.47 | 2.5 |
| Example | 6 | 11 | 31 | 944 | 16.9 | 450 | 0.48 | 2.9 |
| Example | 7 | 22 | 28 | 1219 | 9.4 | 500 | 0.41 | 2.5 |
| Comparative Example | 8 | 8 | 27 | 832 | 17.4 | 440 | 0.53 | 2.5 |
| Example | 9 | 15 | 30 | 870 | 16.7 | 450 | 0.52 | 2.5 |
| Example | 10 | 28 | 25 | 858 | 19.3 | 490 | 0.57 | 2.4 |
| Example | 11 | 20 | 28 | 1184 | 10.2 | 460 | 0.39 | 2.3 |
| Example | 12 | 27 | 23 | 937 | 16.8 | 500 | 0.53 | 2.3 |
| Comparative Example | 13 | 8 | 30 | 1217 | 10.7 | 430 | 0.35 | 2.4 |
| Example | 14 | 28 | 25 | 1219 | 12.2 | 480 | 0.39 | 2.2 |
| Example | 15 | 23 | 31 | 1213 | 11.8 | 470 | 0.39 | 2.9 |
| Example | 16 | 20 | 32 | 831 | 14.4 | 460 | 0.55 | 2.8 |
| Example | 17 | 15 | 32 | 862 | 17.8 | 450 | 0.52 | 2.8 |
| Example | 18 | 28 | 29 | 839 | 16.7 | 470 | 0.56 | 2.5 |
| Comparative Example | 19 | 8 | 29 | 1210 | 11.8 | 420 | 0.35 | 2.4 |
| Example | 20 | 30 | 25 | 1196 | 12.0 | 480 | 0.40 | 2.5 |
| Comparative Example | 21 | 8 | 35 | 976 | 14.6 | 430 | 0.44 | 3.9 |
| Comparative Example | 22 | 6 | 42 | 995 | 12.4 | 410 | 0.41 | 3.1 |
| Example | 23 | 31 | 26 | 994 | 13.2 | 490 | 0.49 | 2.5 |
| Example | 24 | 27 | 25 | 985 | 13.7 | 490 | 0.50 | 2.4 |
| Example | 25 | 17 | 24 | 968 | 13.9 | 460 | 0.48 | 2.4 |

TABLE 7

| Note | No. | Radius of curvature r (μm) | Area ratio (%) | Tensile strength TS (MPa) | Total elongation EL (%) | 200,000 times time intensity (MPa) | 200,000 times time intensity/TS | Limit bending R/t |
|---|---|---|---|---|---|---|---|---|
| Example | 26 | 24 | 25 | 1108 | 13.0 | 470 | 0.42 | 2.2 |
| Example | 27 | 25 | 23 | 1135 | 14.3 | 470 | 0.41 | 2.1 |
| Example | 28 | 28 | 23 | 1120 | 16.1 | 480 | 0.43 | 2.1 |
| Example | 29 | 26 | 23 | 819 | 12.6 | 490 | 0.60 | 2.2 |
| Comparative Example | 30 | 9 | 32 | 602 | 26.2 | 320 | 0.53 | 2.6 |
| Example | 31 | 26 | 28 | 598 | 27.0 | 370 | 0.62 | 2.4 |
| Example | 32 | 28 | 27 | 613 | 27.3 | 360 | 0.59 | 2.2 |
| Example | 33 | 24 | 33 | 563 | 30.2 | 330 | 0.59 | 2.6 |
| Example | 34 | 21 | 31 | 542 | 34.8 | 320 | 0.59 | 2.7 |
| Example | 35 | 19 | 50 | 555 | 32.2 | 320 | 0.58 | 3.6 |
| Example | 36 | 14 | 34 | 572 | 33.5 | 320 | 0.56 | 2.6 |
| Comparative Example | 37 | 7 | 32 | 1137 | 11.9 | 420 | 0.37 | 2.6 |
| Comparative Example | 38 | 9 | 31 | 1124 | 13.8 | 440 | 0.39 | 2.6 |
| Example | 39 | 27 | 25 | 827 | 15.4 | 480 | 0.58 | 2.1 |
| Example | 40 | 25 | 25 | 1175 | 17.8 | 490 | 0.42 | 2.2 |
| Example | 41 | 24 | 28 | 845 | 19.1 | 470 | 0.56 | 2.4 |
| Example | 42 | 25 | 27 | 849 | 19.2 | 470 | 0.55 | 2.5 |
| Example | 43 | 28 | 26 | 861 | 15.8 | 470 | 0.55 | 2.3 |
| Example | 44 | 23 | 29 | 993 | 16.4 | 490 | 0.49 | 2.4 |
| Example | 45 | 24 | 28 | 1202 | 14.9 | 510 | 0.42 | 2.4 |
| Example | 46 | 25 | 22 | 1130 | 14.5 | 500 | 0.44 | 2.1 |
| Example | 47 | 26 | 27 | 1270 | 15.2 | 510 | 0.40 | 2.5 |
| Example | 48 | 30 | 25 | 808 | 18.7 | 470 | 0.58 | 2.4 |
| Comparative Example | 49 | 32 | 25 | 456 | 23.6 | 280 | 0.61 | 1.8 |
| Example | 50 | 11 | 36 | 973 | 17.9 | 455 | 0.47 | 1.4 |

As shown in Tables 1 to 7, all the mechanical properties were suitable in the examples satisfying the conditions of the present invention. On the other hand, in the comparative examples in which at least one of the conditions of the present invention was not satisfied, one or more mechanical properties were not suitable.

BRIEF DESCRIPTION OF THE REFERENCE SYMBOLS

X Rolling direction (L direction) or direction (C direction) perpendicular to rolling direction
Y Direction perpendicular to X
T Sheet thickness direction
H Recessed part
I Average height position
$R_1$ Height of recessed part H
$R_2$ Average height of two points away from recessed part H by 5 μm
10 Scale damage portion
100 Hot-rolled steel sheet

The invention claimed is:

1. A hot-rolled steel sheet comprising, as a chemical composition, by mass %:

C: 0.030% to 0.250%;
Si: 0.05% to 2.50%;
Mn: 1.00% to 4.00%;
Sol. Al: 0.001% to 2.000%;
P: 0.100% or less;
S: 0.0200% or less;
N: 0.01000% or less;
Ti: 0% to 0.20%;
Nb: 0% to 0.20%;
B: 0% to 0.010%;
V: 0% to 1.0%;
Cr: 0% to 1.0%;
Mo: 0% to 1.0%;
Cu: 0% to 1.0%;
Co: 0% to 1.0%;
W: 0% to 1.0%;
Ni: 0% to 1.0%;
Ca: 0% to 0.01%;
Mg: 0% to 0.01%;
REM: 0% to 0.01%;
Zr: 0% to 0.01%; and
a remainder comprising Fe and impurities, wherein, when a height profile of a surface of the hot-rolled steel sheet is measured in each of five measurement ranges in a rolling direction and a direction perpendicular to the rolling direction, a distance in a height direction from an average height position which is an average of a height position of a point having a highest height position and a height position of a recessed part which is a point having a lowest height position to the recessed part is indicated as $R_1$ (μm) in each of the height profiles, and a distance in a height direction from the average height position to an average of height positions of two measurement points away from the recessed part in the rolling direction or the direction perpendicular to the rolling direction by 5 μm is indicated as $R_2$ (μm), an average value of radii of curvature r represented by Expression (1) is 10 μm or more, a tensile strength of the hot-rolled steel sheet is 500 MPa or more, and when the recessed part in which the $R_1$ is 10 μm or more is referred to as a scale damage portion, an area ratio of the scale damage portion is 30% or less, $$r=(25+|R_2-R_1|^2)/2|R_2-R_1| \quad (1).$$

2. The hot-rolled steel sheet according to claim 1 comprising at least one of, as the chemical composition, by mass %:

Ti: 0.001% to 0.20%;
Nb: 0.001% to 0.20%;
B: 0.001% to 0.010%;
V: 0.005% to 1.0%;
Cr: 0.005% to 1.0%;
Mo: 0.005% to 1.0%;
Cu: 0.005% to 1.0%;
Co: 0.005% to 1.0%;
W: 0.005% to 1.0%;
Ni: 0.005% to 1.0%;
Ca: 0.0003% to 0.01%;
Mg: 0.0003% to 0.01%;
REM: 0.0003% to 0.01%; and
Zr: 0.0003% to 0.01%.

* * * * *